US006507271B2

(12) United States Patent
Taguchi et al.

(10) Patent No.: US 6,507,271 B2
(45) Date of Patent: Jan. 14, 2003

(54) RESISTOR EXCELLENT IN MICRO-LINEARITY CHARACTERISTIC AND VARIABLE RESISTOR USING THE SAME

(75) Inventors: Yoshihiro Taguchi, Miyagi-ken (JP); Hisashi Komatsu, Miyagi-ken (JP); Takayuki Fujita, Miyagi-ken (JP); Michita Suzuki, Miyagi-ken (JP)

(73) Assignee: ALPS Electric Co., Ltd, Tokyo (JP)

( * ) Notice: Subject to any disclaimer, the term of this patent is extended or adjusted under 35 U.S.C. 154(b) by 0 days.

(21) Appl. No.: 10/001,130

(22) Filed: Oct. 30, 2001

(65) Prior Publication Data

US 2002/0075130 A1 Jun. 20, 2002

(30) Foreign Application Priority Data

Oct. 31, 2000 (JP) ..... 2000-337261

(51) Int. Cl.[7] ..... H01C 1/012

(52) U.S. Cl. ..... 338/308; 338/160; 338/254; 338/252

(58) Field of Search ..... 338/308, 160, 338/162, 254, 252

(56) References Cited

U.S. PATENT DOCUMENTS

| | | | | | |
|---|---|---|---|---|---|
| 3,602,861 | A | * | 8/1971 | Tweed et al. | 338/9 |
| 4,345,236 | A | * | 8/1982 | Eichelberger et al. | 338/176 |
| 4,647,900 | A | * | 3/1987 | Schelhorn et al. | 338/314 |
| 5,111,178 | A | * | 5/1992 | Bosze | 338/160 |
| 5,475,359 | A | * | 12/1995 | Hatayama et al. | 338/160 |
| 5,781,100 | A | * | 7/1998 | Komatsu | 338/252 |
| 6,172,595 | B1 | | 1/2001 | Komatsu et al. | |

OTHER PUBLICATIONS

JP 3211706 english abstract and single image (Sep.1991).*

* cited by examiner

*Primary Examiner*—Karl D. Easthom
(74) *Attorney, Agent, or Firm*—Beyer Weaver & Thomas

(57) ABSTRACT

A resistor is provided that is made by laminating at least two resistive layers, where these resistors have conductive particles held in a binder resin. The resistors are laminated such that a top resistor covers a bottom resistor, and a surface of the top resistor is exposed. The resistivity of the top resistor is made smaller than that of the bottom resistor. The top resistor contains carbon fiber and carbon black, where the central particle size of the carbon fiber ranges from 3.5 to 9.0 μm. The resistor has excellent durability and micro-linearity characteristics. The resistor may also be used as a variable resistor.

12 Claims, 4 Drawing Sheets

| | Upper layer | | | | Lower layer | | | | | |
|---|---|---|---|---|---|---|---|---|---|---|
| | Percentage content of carbon black (volume %) | Carbon fiber | | Resistivity (Ω cm) | Percentage content of carbon black (volume %) | Carbon fiber | | Resistivity (Ω cm) | Variation | Maximum abrasion loss (μm) |
| | | Percentage content (volume %) | Central particle diameter (μm) | | | Percentage content (volume %) | Central particle diameter (μm) | | | |
| Embodiment 1 | 15 | 18 | 7.2 | 4.67 | 15 | 16 | 1.4 | 5.94 | 0.029 | 0 |
| Embodiment 2 | 15 | 18 | 7.2 | 4.67 | 15 | 16 | 3.4 | 4.8 | 0.029 | 0 |
| Embodiment 3 | 15 | 18 | 7.2 | 4.67 | 15 | 16 | 1.4 | 5.94 | 0.03 | 0 |
| Embodiment 4 | 18 | 18 | 7.2 | 0.03 | 15 | 16 | 1.4 | 5.94 | 0.027 | 0 |
| Embodiment 5 | 15 | 10 | 8.7 | 1.1 | 15 | 10 | 2 | 1.9 | 0.027 | 0 |
| Embodiment 6 | 20 | 10 | 8.7 | 0.56 | 10 | 16 | 2 | 4.85 | 0.0305 | 0 |
| Embodiment 7 | 20 | 20 | 8.7 | 0.37 | 15 | 10 | 2 | 0.9 | 0.028 | 0 |
| Embodiment 8 | 20 | 20 | 8.7 | 0.37 | 15 | 0 | - | 0.95 | 0.027 | 0 |
| Embodiment 9 | 20 | 20 | 9 | 0.02 | 15 | 15 | 1.4 | 5.8 | 0.031 | 0 |
| Comparative example 1 | 15 | 0 | - | 1.2 | 15 | 16 | 2 | 1.05 | - | 10 |
| Comparative example 2 | 15 | 15 | 1.4 | 5.8 | 15 | 15 | 1.4 | 4.5 | - | 8 |
| Comparative example 3 | 20 | 16 | 2 | 0.3 | 20 | 16 | 2 | 0.3 | - | 3 |
| Comparative example 4 | 15 | 16 | 3.4 | 2.95 | 10 | 15 | 1.4 | 16 | - | 0.5 |
| Comparative example 5 | 15 | 16 | 8.7 | 1.78 | 15 | 10 | 2 | 0.9 | 0.042 | 0 |
| Comparative example 6 | 15 | 16 | 8.7 | 1.78 | 15 | 16 | 2 | 1.47 | 0.0333 | 0 |

Fig. 7

RESISTOR EXCELLENT IN MICRO-LINEARITY CHARACTERISTIC AND VARIABLE RESISTOR USING THE SAME

BACKGROUND OF THE INVENTION

Field of the Invention

The present invention relates to discrete resistors. More particularly, the invention relates to resistive components with high micro-linearity characteristic.

Description of the Related Art

A conventional resistor which has been used for variable resistors of various sensors has at least two layers consisting of a lower layer and an upper layer. The exposed surface of the upper layer functions as a face on which a slider is slid. The upper layer and the lower layer contain conductive particles such as carbon black, embedded in a binder resin, where the upper layer usually has a larger resistivity than the lower layer. The upper layer is designed to withstand continual friction by the slider without effecting the electric characteristic of the resistor throughout its product life. A resistor used for a high-precision sensor is required to have an excellent micro-linearity characteristic. The graph shown in FIG. 4 illustrates how the micro-linearity characteristic of a resistor varies with the central particle size of the carbon fiber (CF), and the amount of carbon black (CB) and carbon fiber (CF) contained in the upper layer.

Generally, the factor with the largest change in signal-to-noise ratio has the greatest influence on micro-linearity. As indicated in the graph, the amount of carbon black contained in the upper layer has the largest influence on micro-linearity.

FIG. 5 is a graph showing the relationship between the resistivity of the upper layer and the micro-linearity characteristic when the central particle size range of the carbon fiber contained in the upper layer is 1.4 $\mu$m or 8.7 $\mu$m. As described later, a smaller variation results in better micro-linearity characteristic. As shown in FIG. 3, within a certain range, a lower resistance relative to the lower layer results in improved micro-linearity characteristic.

In known resistor with a similar configuration (i.e., two or more layers where the upper layer is set to a higher value than that of the lower layer) there is a problem in achieving adequate micro-linearity for such applications as high-precision variable resistors. Additionally, the product life of many know variable resistors is shortened because they contain no carbon fibers in the upper layer.

SUMMARY OF THE INVENTION

The object of the invention is to provide a resistor excellent in micro-linearity characteristic and further, durability to sliding as well as a high-precision variable resistor using the resistor and having a long life.

To achieve the foregoing and in accordance with the objects of the invention, a resistor is made by laminating at least two resistive layers, where these resistors have conductive particles held in a binder resin. The resistors are laminated such that a top resistor covers a bottom resistor, and a surface of the top resistor is exposed. The resistivity of the top resistor is made smaller than that of the bottom resistor. The top resistor contains carbon fiber and carbon black, where the central particle size of the carbon fiber ranges from 3.5 to 9.0 $\mu$m.

In some embodiments the top resistor includes carbon fiber and carbon black. The central particles size of the carbon fiber contained in the top resistor can be equal to or smaller than that of the carbon fiber contained in the bottom resistor. In other embodiments the bottom resistor may contain carbon fibers in the range of 16 to 20% by volume, and/or have a resistivity less than, but at least equal to one tenth of the resistivity of the top resistor. The bottom resistor may also have a maximum surface roughness of 0.5 $\mu$m.

In other embodiments, the resistor made according to the present invention may be used as a variable resistor where additional aspects include making the central particle size of the carbon fiber contained in the top resistor equal to or smaller than that of the carbon fiber contained in the second resistor.

BRIEF DESCRIPTION OF THE DRAWINGS

FIG. 7 is a table showing the configuration of a resistor according to the first to ninth embodiments of the present invention;

DETAILED DESCRIPTION OF THE PREFERRED EMBODIMENTS

Figure 6:
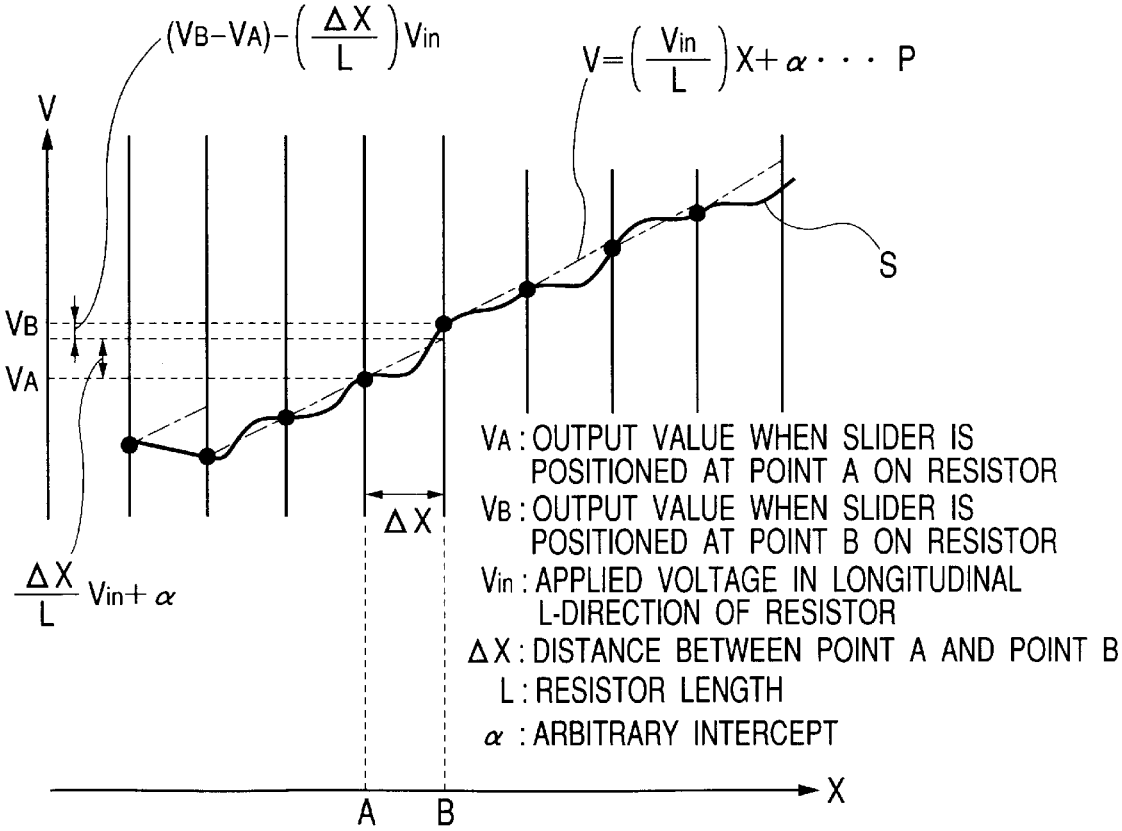
FIG. 6 is an explanatory drawing showing the micro-linearity characteristic.

Initially, the micro-linearity characteristic will be described. In a graph shown in FIG. 6, when rated voltage Vin is applied in a longitudinal L-direction of a resistor pattern, the y-axis shows output V from a slider slid in the direction of the length on the resistor pattern and the x-axis shows the position X of the slider on the resistor pattern. On the premise that the specific resistance of the resistor is fixed independent of the position, the change of output when the slider is moved from an arbitrary point by $\Delta X$ on the resistor pattern can be shown by an ideal straight line P having the inclination of $(\Delta X/L)\times Vin$.

For the ideal straight line P, reference output displacement when the slider is moved from a point A to a point B by $\Delta X$ can be expressed by $\Delta V=(\Delta X/L)\times Vin$, however, actual output S is off the ideal straight line P. As shown in the following expression 1, the variation of the actual output S from the ideal straight line P is defined as a difference between the output displacement VB−VA of each actual output Va and VB at the points A and B and reference output displacement shown by the percentage of applied voltage. The smaller the variation is, the better the micro-linearity characteristic is. In this way, the ideal micro-linearity characteristic is line P. For high-performance positional sensor applications, that actual output S must have a high micro-linearity; that is, be very close to the ideal straight line P.

$$\text{Variation} = \frac{(V_B - V_A) - \left[\frac{\Delta X}{L}\right]V_{in}}{V_{in}} \times 100 \qquad \text{[Equation 1]}$$

$V_A$: Output value when slider is positioned at point A $V_B$: Output value when slider is positioned at point B $V_{in}$: Applied voltage in longitudinal L-direction of resistor $\Delta X$: Distance between point A and point B L: Resistor length A resistor made according to the present invention by laminating at least two resistive layers, where these resistors have conductive particles held in a binder resin. The resistors are laminated such that a top resistor covers a bottom resistor, and a surface of the top resistor is exposed. The resistivity of the top resistor is made smaller than that of the bottom resistor. The top resistor contains carbon fiber and carbon black, where the central particle size of the carbon fiber ranges from 3.5 to 9.0 $\mu$m.

In such a resistor, the conductive particles serve to apply conductivity to the first and second resistors. If binder resin has only to serve to uniformly disperse the conductive particles and to bind these, the material is not limited and for example, thermosetting resin such as phenol-formaldehyde resin, xylene denatured phenol resin, epoxy resin, polyimide resin, melamine resin, acrylic resin, acrylate resin, furfuryl resin and polyimide resin and others can be used.

The carbon black contained in the second resistor is conductive particles for applying conductivity to the second resistor, and acetylene black, furnace black, channel black and others can be used. The resistivity of the second resistor can be regulated by the percentage content of the carbon black.

The carbon fiber contained in the second resistor is conductive particles and serves to apply conductivity to the second resistor, to disperse and support a load applied to the resistor by the slider in a direction of fiber length and to enhance the durability to the sliding of the slider of the resistor. Therefore, the resistor is not shaved by the slider and no variation of the electric characteristic by the shaving of the resistor occurs.

Further, the carbon fiber provides a very good electrical contact between the resistor and the slider, and support sufficient electrical loads. However, if the central particle size of the carbon fiber is smaller than 3.5 $\mu$m, then adequate electrical loads cannot be supported.

Generally, as carbon fiber has anisotropy in conduction that a current is liable to flow in the direction of fiber length, an influence of the anisotropy in conduction of the carbon fiber becomes remarkable when the central particle size of the carbon fiber exceeds 9.0 $\mu$m and the micro-linearity characteristic of the resistor beings to deteriorate.

Such a resistor can have a desired value by reducing the resistivity of the second resistor on which the slider is slid, reducing contact resistance between the slider and the resistor, enhancing the micro-linearity characteristic of the resistor. The desired resistance of the resistor formed according to the present invention can be set by making the other resistor(s) have the required value.

In the resistor according to the invention, the first resistor contains carbon fiber and carbon black.

In such a resistor, the carbon black contained in the first resistor is a conductive particle that applies conductivity to the first resistor and the resistivity of the first resistor can be regulated by the percentage content of the carbon black. For the carbon black, acetylene black, furnace black, channel black and others can be used.

The carbon fiber contained in the first resistor is a conductive particle that applies conductivity to the first resistor and serves to enhance the hardness of the first resistor, to support the second resistor and to prevent the second resistor from sinking when the second resistor is pressed by the slider.

In the resistor according to the invention, a central particle size of the carbon fiber contained in the first resistor is equal to or smaller than that of the carbon fiber contained in the second resistor.

In such a resistor, if the central particle size of the carbon fiber contained in the first resistor is small, there is a correspondingly small micro-linearity degradation effect caused by the carbon fiber contained in the first resistor.

In the resistor according to the invention, the second resistor contains carbon fiber by 16 to 20% by volume.

In such a resistor, as the carbon fiber is contained in the second resistor by 16% by volume or more, enough points which support the load of the slider exist and the durability to sliding is enhanced. When the percentage content of the carbon fiber in the second resistor is 20% by volume or less, the amount of binder resin to the carbon fiber is enough and the carbon fiber is completely bound by the binder resin. Therefore, a pattern can be accurately formed in a screen printing process without the carbon fiber getting out of the resistor, the surface of the resistor is smoothed and the durability again sliding can be maintained.

Further, when the percentage content of the carbon fiber in the second resistor is 20% by volume or less, it is suitable for patterning in the screen printing process.

In the resistor according to the invention, preferably a ratio of the resistivity of the second resistor to the resistivity of the first resistor is between 0.1 and 1.

In such a resistor, when the resistivity of the second resistor is smaller than that of the first resistor, contact resistance between the resistor and the slider decreases and the micro-linearity characteristic is enhanced, while the anisotropy in conduction of the carbon fiber contained in the second resistor has an influence upon the micro-linearity characteristic. Therefore, an optimum micro-linearity characteristic can be acquired by setting the resistivity of the second resistor in a suitable range, as set forth above, for the resistivity of the first resistor.

In the resistor according to the invention, a surface of the second resistor is smoothed and maximum surface roughness is preferably set to 0.5 $\mu$m or less.

In such a resistor, as the surface on which the slider is slid of the resistor is smooth and the slider is smoothly slid, impact upon the slider is negligible. This extends the life of the resistor, and induced noise in the output signal due to the slider can be significantly prevented.

Figure 2:
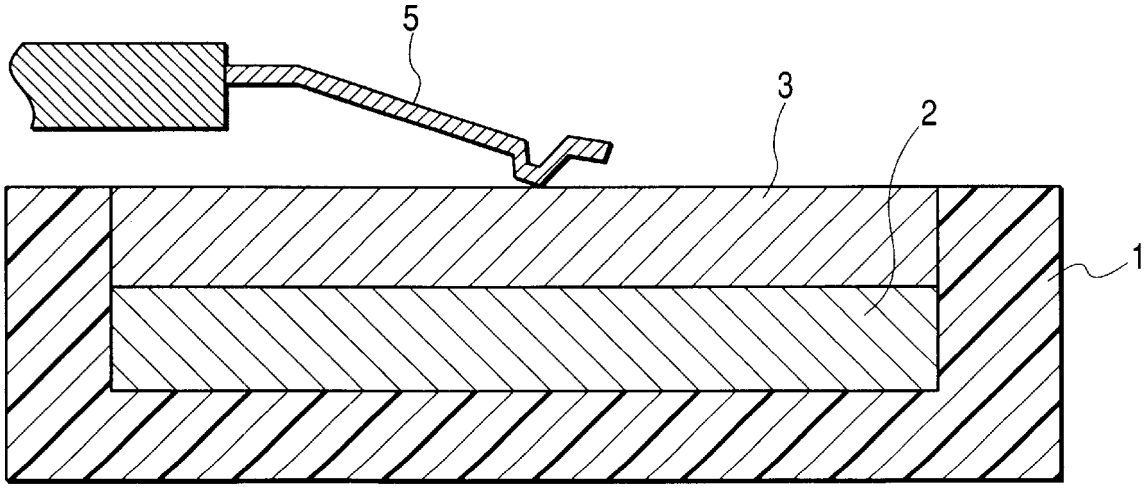
FIG. 2 is a sectional view viewed along a line 2—2 in FIG. 1.

An embodiment of a resistor according to the invention will be described below. The embodiment of the resistor according to the invention has a two-layer structure in which a lower layer 2 which is a first resistor and an upper layer 3 which is a second resistor are sequentially laminated in a concave portion of base material 1 as shown in FIG. 2 and is set to a predetermined resistance value as a whole.

The lower layer 2 contains carbon black (acetylene black) or carbon black and carbon fiber in acetylene terminal polyimide resin which functions as binder.

The carbon black and the carbon fiber serve to apply conductivity to the lower layer 2 as conductive particles and particularly, the resistivity of the lower layer 2 can be regulated by the percentage content of carbon black.

Acetylene terminal polyimide resin which functions as binder serves to uniformly disperse carbon black and carbon fiber in the lower layer 2 and bind these.

The percentage content of carbon black in the lower layer 2 is 10 to 15% by volume. When the lower layer 2 contains carbon fiber, the percentage content of the carbon fiber (hereinafter called first carbon fiber) contained in the lower layer 2 is 10 to 16% by volume and the central particle size range of the first carbon fiber is 1.4 to 3.4 $\mu$m.

The central particle size of the carbon fiber means the central particle size of distribution when normal distribution can be applied to the particle size distribution of the carbon fiber.

The first carbon fiber is acquired by grinding commercial carbon fiber (for example, Torayca MLD product of Toray, and Besfight HTA-CMF product of Toho Rayon) of which the fiber size is approximately 8 $\mu$m and of which the fiber length ranges from 10 $\mu$m to approximately 100 $\mu$m (central particle size: 20 $\mu$m).

To grind commercial carbon fiber, a jet mill grinding method is used and for a grinding condition, commercial carbon fiber is thrown at the rate of 1 to 3 g per minute, and setting compressed air of 6 to 7 kg/cm$^2$ flow into a cyclone having the size of 150 mm at the rate of 0.2 to 0.6 m$^3$ per minute.

It is desirable that a coupling process is applied to the first carbon fiber. To describe the coupling process of the first carbon fiber in detail, after carbon fiber on the market is ground, it is mixed with water and ethanol by a coupling agent such as aminosilanate and after it is stirred for approximately two hours, it is filtered and is dried at approximately 100° C.

For the coupling agent, a silanate, titanate or alumina coupling agent can be also used. The dispersibility and adhesiveness of the first carbon fiber in/to binder resin are enhanced by such a coupling process.

The upper layer 3 contains carbon black (acetylene black) of 15 to 20% by volume and carbon fiber of 10 to 20% by volume in acetylene terminal polyimide resin which functions as binder. The surface of the upper layer 3 is at the substantially same level as the surface of the base material 1 and the maximum surface roughness is 0.5 $\mu$m or less.

The carbon black and the carbon fiber serve to apply conductivity to the upper layer 3 as a conductive particle and particularly, the resistivity of the upper layer 3 can be adjusted according to the percentage content of carbon black.

The central particle size range of carbon fiber contained in the upper layer 3 (hereinafter called second carbon fiber) is 7.2 to 9.0 $\mu$m and is acquired by grinding carbon fiber on the market and applying a coupling process to it like the first carbon fiber.

Acetylene terminal polyimide resin which functions as binder resin serves to uniformly disperse carbon black and carbon fiber in the upper layer 3 and to bind these.

Next, a method of manufacturing the resistor according to the invention will be described. First, the upper layer 3 will be described. Resistant paste for the upper layer is acquired by adding acetylene black, the second carbon fiber and a printable modifier if necessary in a solvent in which acetylene terminal polyimide resin is dissolved, mixing and dispersing them using three roll mills. The solvent has only to be something to dissolve acetylene terminal polyimide resin and one or more types of glycol, ester, ether and others may be used.

Next, the resistant paste for the upper layer is patterned on the smooth surface of a metallic plate by screen printing. At this time, as the percentage content of the second carbon fiber in the upper layer 3 is 20% by volume or less, the second carbon fiber is prevented from getting out of binder resin and projecting out of a pattern.

Next, the upper layer 3 is completed by applying a heating process at 200° C. for thirty minutes, drying and hardening the resistant paste for the upper layer. At this time, as the solvent is volatilized by the heating process, the upper layer 3 contains no solvent component.

The lower layer 2 is laminated on the upper layer 3 and is formed as the upper layer 3. The upper layer 3 and the lower layer 2 are transferred from the metallic plate and the base material 1. At this time, the surface of the upper layer 3 is smooth because the surface of the metallic plate is smooth, and the maximum surface roughness is inhibited so that it is 0.5 $\mu$m or less. As the percentage content of the second carbon fiber in the upper layer 3 is 20% by volume or less, the second carbon fiber is prevented from getting out of binder resin and projecting from the surface of the upper layer 3.

In another embodiment of the present invention a variable resistor is formed using the abovementioned resistor. When the resistor is used for a rotary variable resistor, it is formed in the shape of a resistor pattern P in the shape of an arc shown in FIG. 1 and when the resistor is used for a slide type variable resistor, it is elongated. This variable resistor embodiment additionally uses the above mentioned slider that is slid on the surface of the second resistor, where the slider could be made of metal.

In such a variable resistor, as the durability of the surface of the resistor on which the slider is slid to sliding is excellent, the variable resistor has a long life and as the micro-linearity characteristic of the resistor is satisfactory, it can be used for a high-precision sensor. A silver electrode 4 is connected to both ends of such a resistor pattern P and a slider 5 made of noble metal is mounted so that it is slid on the upper layer 3 and is moved along the resistor pattern P.

For the slider 5, noble metal which also keeps satisfactory contact with the resistor in sliding for a long term is used and concretely, something acquired by applying gold plating and silver plating to the surface of nickel silver and an alloy mainly made of palladium, silver, platinum or gold can be used.

When such a variable resistor is driven, constant voltage is applied from the silver electrode 4 to the resistor pattern P and the position of the slider 5 on the resistor pattern P is detected in the reference position of the resistor pattern P based upon an output voltage signal between a fixed contact (not shown) electrically connected to the resistor pattern P and the slider moved on the resistor pattern P.

At this time, as the second carbon fiber contained in the upper layer 3 serves to support a load applied to the resistor by the slider, the durability to the sliding of the slider 5 of the resistor is enhanced.

Further, as the second carbon fiber which is a conductive particle supports the load of the slider 5, electric contact between the resistor and the slider 5 is stabilized.

The first carbon fiber contained in the lower layer 2 enhances the hardness of the lower layer 2, supports the upper layer 3 and prevents the upper layer 3 from sinking by the pressure of the slider 5.

As the surface of the upper layer 3 on which the slider 5 is slid is smooth, the slider 5 is smoothly moved on the resistor. Therefore, impact upon the slider 5 is inhibited and an output voltage signal from the slider 5 is prevented from being disturbed by the impact.

When the resistivity of the upper layer 3 is small, contact resistance between the slider 5 and the resistor decreases and the micro-linearity characteristic of the resistor is enhanced. Each resistivity of the upper layer 3 and the lower layer 2 can be regulated by the percentage content of carbon black respectively contained in them. When the resistivity of the upper layer 3 is reduced, the resistance value of the whole resistor composed of the upper layer 3 and the lower layer 2 can be set to a desired value by regulating the resistivity of the lower layer 2.

The micro-linearity characteristic of the resistor is influenced by the central particle size of the carbon fiber respectively contained in the upper layer 3 and the lower layer 2. As the carbon fiber has anisotropy in conduction that a current is liable to flow in the direction of fiber length, the resistivity minutely varies for every current path depending upon the degree of the orientation in the direction of the fiber length of the carbon fiber in the current path when the upper layer 3 or the lower layer 2 contains the carbon fiber of which the central particle size is large, and the micro-linearity characteristic is deteriorated.

Embodiments in which the percentage content of the carbon black and the carbon fiber in the upper layer 3 and the lower layer 2 and the central particle size of the carbon fiber are respectively different will be described below.

(Embodiments)

FIG. 7 is a table showing the configuration of the resistor in first to ninth embodiments of the invention.

Figure 1:
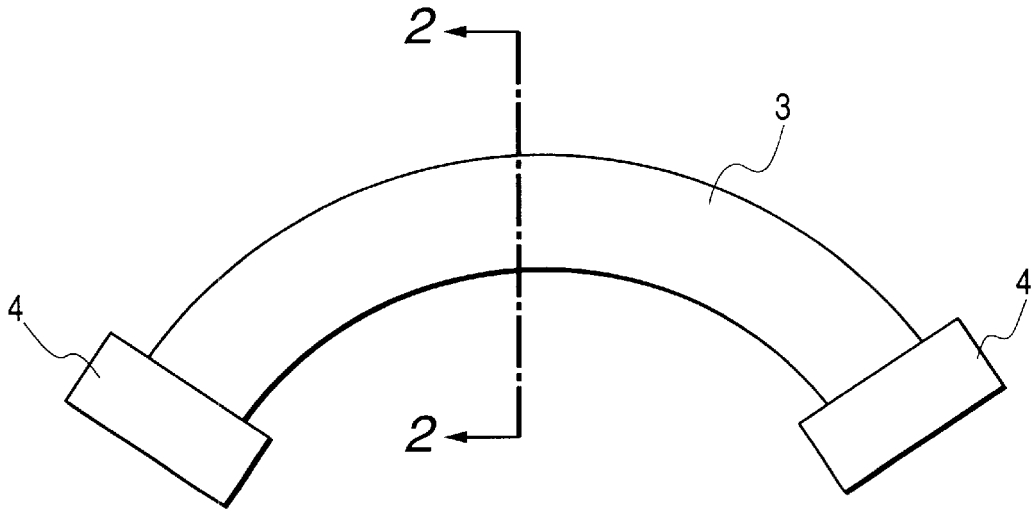
FIG. 1 illustrates a variable resistor according to the invention.

These resistors are formed as the resistor pattern P in the shape of an arc of which the radius is approximately 7 mm as shown in FIGS. 1 and 2, the thickness of the upper layer 3 is set to approximately 5 $\mu$m, the thickness of the lower layer 2 is set to approximately 5 $\mu$m and the resistance value of the whole is set to 2.4 kΩ. The silver electrode 4 is connected to both ends of the resistor pattern P.

The slider 5 is made of an alloy including six elements and is revolved on the resistor pattern P. The total angle of rotation of the slider 5 for the resistor pattern P is approximately 120°.

A method of measuring the micro-linearity characteristic will be described below. Suppose that in a state in which the voltage of 5 V is applied from the silver electrode 4 to the resistor pattern P, an ideal straight line of the micro-linearity characteristic has the inclination of 42 mV/deg. from a reference point at which the rotation angle of the slider is 10° and the output of which is 0.5 V. The output is measured every time the slider is revolved by 0.1 deg. and the magnitude of a range in which the output of measurement varies for the ideal straight line is shown as the percentage of the applied voltage 5V. It can be said that the smaller the variation is, the better the micro-linearity characteristic is.

For a method of testing the durability to sliding, after the slider 5 finishes the reciprocation of five million cycles, the worn state of the surface of the resistor is observed and the maximum abrasion loss of the surface of the resistor is measured using a probe-type surface roughness meter.

As clear from FIG. 7, in first to ninth embodiments in which the central particle size range of the carbon fiber contained in the upper layer 3 is 7.2 to 9.0 $\mu$m and the resistivity of the upper layer 3 is smaller than that of the lower layer 2, the micro-linearity characteristic is excellent and the maximum abrasion loss is substantially zero. Further, it is verified that the durability to sliding is also kept even if the ambient temperature of the test of the durability to sliding varies from −40 to 125° C.

In the meantime, the durability to sliding is deteriorated in a comparative example 1 that the upper layer 3 contains no carbon fiber and in comparative examples 1 to 4 that the central particle size range of carbon fiber contained in the upper layer 3 is 1.4 to 3.4 $\mu$m, compared with that in the first to ninth embodiments.

In comparative examples 5 and 6 that the resistivity of the upper layer 3 is larger than that of the lower layer 2, the micro-linearity characteristic is deteriorated, compared with that in the first to ninth embodiments.

Figure 3:
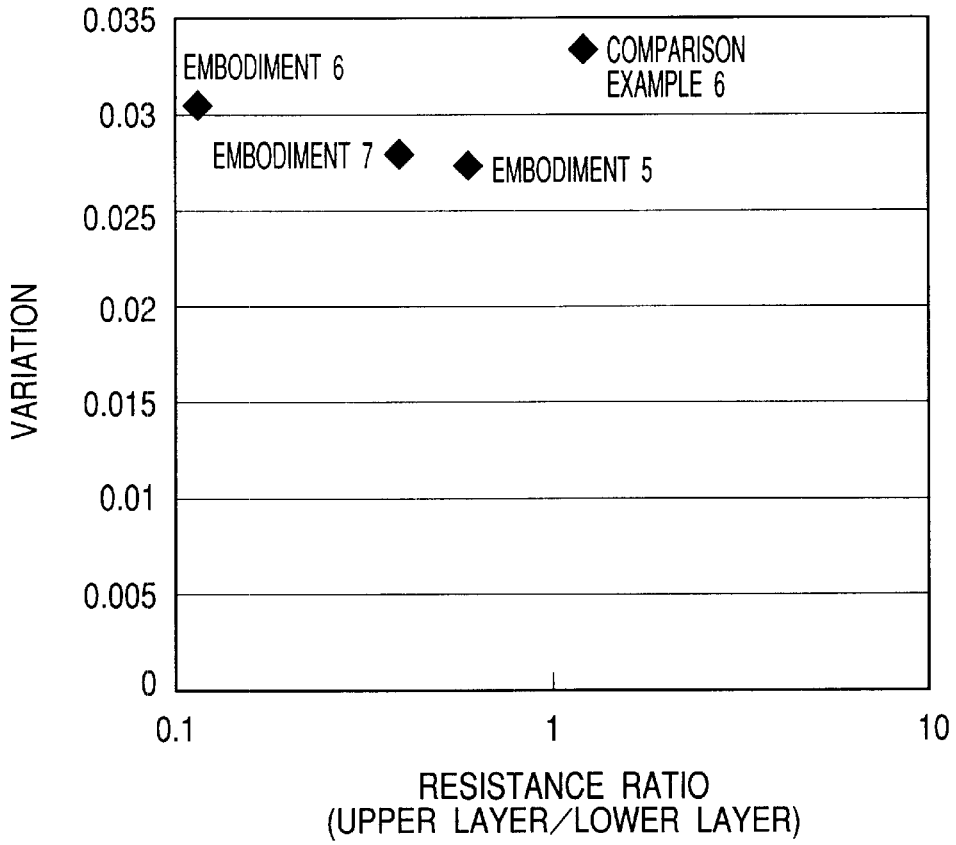
FIG. 3 is a graph showing the influence on the micro-linearity characteristic of the resistivity of an upper layer verses that of a lower layer.
Figure 4:
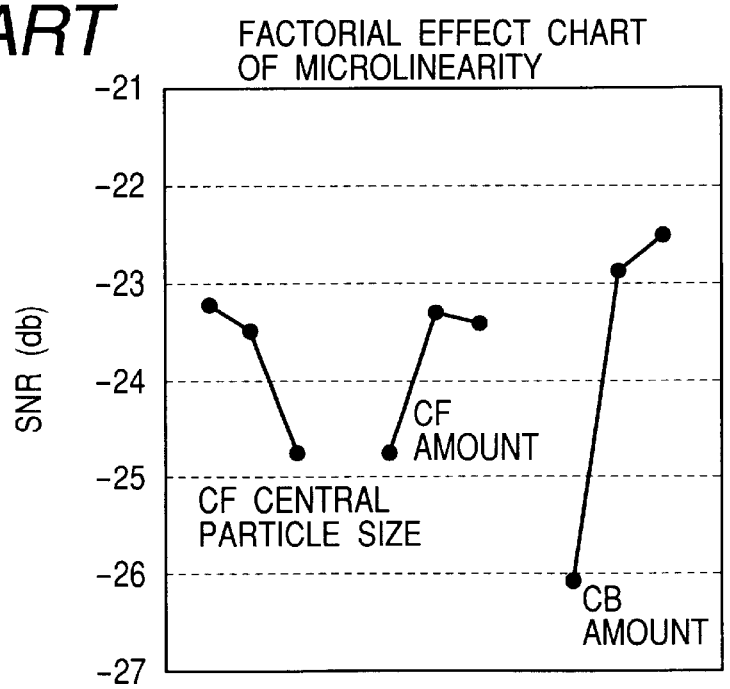
FIG. 4 PRIOR ART
FIG. 4 shows the factorial effect of micro-linearity.
Figure 5:
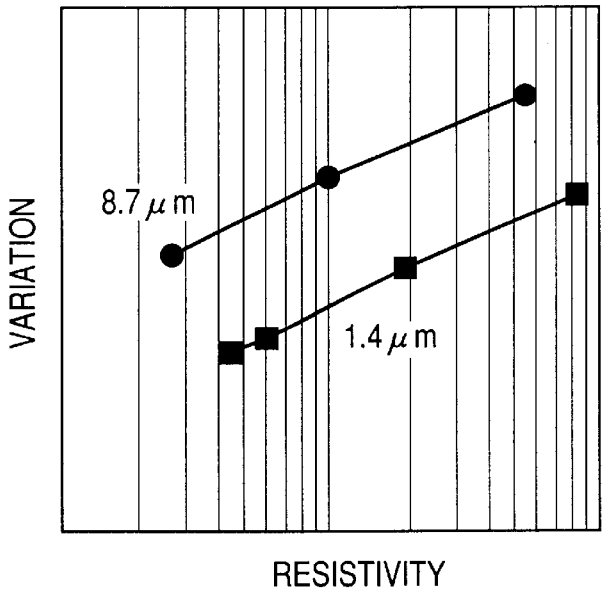
FIG. 5 PRIOR ART
FIG. 5 is a graph showing the influence resistivity in the upper layer on the micro-linearity characteristic.

FIG. 3 is a graph showing an influence of the resistivity of the upper layer 3 to that of the lower layer 2 upon the micro-linearity characteristic in the sixth, seventh and fifth embodiments and the comparative example 6 shown in Table 1. As clear from this graph, when the ratio of the resistance (the upper layer/the lower layer) decreases from that in the comparative example 6 to that in the fifth embodiment, the micro-linearity characteristic is enhanced, however, when the ratio of the resistance (the upper layer/the lower layer) further decreases from that in the seventh embodiment to that in the sixth embodiment, the micro-linearity characteristic is slightly deteriorated.

This is because, when the resistivity of the upper layer 3 to that of the lower layer 2 becomes small, the micro-linearity characteristic is enhanced, while the anisotropy in conduction of the carbon fiber contained in the upper layer 3 has an influence upon the micro-linearity characteristic. Therefore, it is desirable that the ratio of the resistivity of the upper layer 3 to that of the lower layer 2 is 0.1 or more.

The first and second resistors forming the resistor according to the invention contain conductive particles in binder resin, the second resistor contains carbon fiber and carbon black, the central particle size range of the carbon fiber contained in the second resistor is 3.5 to 9.0 $\mu$m, the resistivity of the second resistor is smaller than the resistivity of the first resistor, at least the first and second resistors are laminated, the second resistor covers the upside of the first resistor and the surface is formed by the second resistor.

As such a resistor is provided with at least the first and second resistors, the resistor can have a desired value by reducing the resistivity of the second resistor on which the slider is slid, enhancing the micro-linearity characteristic of the resistor and regulating the resistance value of the whole resistor by the first resistor of which the resistivity is large.

The carbon fiber contained in the second resistor is conductive particles, applies conductivity to the second resistor and can disperse and support a load applied from the slider to the resistor in the direction of fiber length. Therefore, the durability of the resistor to the load of the slider is enhanced and the characteristic is also kept even if the ambient temperature varies. Electric contact between the resistor and the slider is stabilized because the carbon fiber which is conductive particles supports the load of the slider.

Although only a few embodiments of the present invention has been described in detailed, it should be understood that the present invention may be embodied in many other specific forms without departing from the spirit or scope of the invention. For example, the resistor formed according to the present invention could be shaped or structured in a variety of different ways, while preserving it advantageous micro-linearity characteristics. Moreover, the resistor is contemplated to be suitable in a variety of applications including precision sensors or accurate position determining. Therefore, the present examples are to be considered as illustrative and not restrictive, and the invention is not to be limited to the details given herein, but may be modified within the scope of the appended claims.

What is claimed is:

1. A discrete resistor comprising:

a first and second resistor, wherein the first and second resistors contain conductive particles in a binder resin, and the resistivity of the second resistor is smaller than that of the first resistor, and the first and second resistors are laminated such that the second resistor covers a top surface of the first resistor, and a surface of the second resistor is exposed; and the second resistor further contains carbon fiber and carbon black, wherein a central particle size range of the carbon fiber contained in the second resistor is 3.5 to 9.0 $\mu$m.

2. A discrete resistor according to claim 1, wherein the first resistor contains carbon fiber and carbon black.

3. A discrete resistor according to claim 2, wherein a central particle size of the carbon fiber contained in the first resistor is equal to or smaller than that of the carbon fiber contained in the second resistor.

4. A discrete resistor according to claim 1, wherein the second resistor contains carbon fiber by 16 to 20% by volume.

5. A discrete resistor according to claim 1, wherein a ratio of the resistivity of the second resistor to the resistivity of the first resistor is greater than or equal to 0.1 and less than 1.

6. A discrete resistor according to claim 1, wherein a surface of the second resistor is smoothed, and the maximum surface roughness is 0.5 $\mu$m or less.

7. A variable resistor, wherein the resistor according to claim 1 is used; and a slider made of metal is slid on the surface of the second resistor.

8. A variable resistor according to claim 7, wherein the first resistor in the discrete resistor contains carbon fiber and carbon black.

9. A variable resistor according to claim 8, wherein the central particle size of the carbon fiber contained in the first resistor in the discrete resistor is equal to or smaller than that of the carbon fiber contained in the second resistor.

10. A variable resistor according to claim 7, wherein the second resistor in the discrete resistor contains carbon fiber in the range of 16 to 20% by volume.

11. A variable resistor according to claim 7, wherein the ratio of the resistivity of the second resistor to the resistivity of the first resistor is greater than or equal to 0.1 and less than 1.

12. A variable resistor according to claim 7, wherein the surface of the second resistor in the discrete resistor is smoothed, and wherein the maximum surface roughness is 0.5 $\mu$m or less.

* * * * *

UNITED STATES PATENT AND TRADEMARK OFFICE

CERTIFICATE OF CORRECTION

PATENT NO. : 6,507,271 B2
DATED : January 14, 2003
INVENTOR(S) : Taguchi et al.

It is certified that error appears in the above-identified patent and that said Letters Patent is hereby corrected as shown below:

Column 1,
Line 46, change “know” to -- known --
Line 65, change “particles” to -- particle --.

Column 3,
Line 42, change “beings” to -- begins --

Column 4,
Line 1, change “if” to -- as --.
Line 52, change “conductive particles and particularly” to -- conductive paticles. The --
Line 64, change “means” to -- determines --.

Column 5,
Line 9, change “and setting” to -- making the --

Column 8,
Line 38, change “detailed” to -- detail --

Signed and Sealed this

Twenty-sixth Day of August, 2003

JAMES E. ROGAN
*Director of the United States Patent and Trademark Office*